US005326301A

United States Patent [19]

Woodside

[11] Patent Number: 5,326,301

[45] Date of Patent: Jul. 5, 1994

[54] AIR PROPELLED TOY DRAGSTER CAR

[76] Inventor: James C. Woodside, 2800 W. Lower Springboro Rd., Franklin, Ohio 45005

[21] Appl. No.: 977,541

[22] Filed: Nov. 17, 1992

[51] Int. Cl.[5] ..... A63H 29/10; A63H 27/00

[52] U.S. Cl. ..... 446/176; 446/61; 446/429; 446/488

[58] Field of Search ..... 446/62, 61, 63, 66, 446/67, 80, 176, 180, 202, 429, 435, 487–489; 280/28

[56] References Cited

U.S. PATENT DOCUMENTS

| | | | |
|---|---|---|---|
| D. 168,724 | 2/1953 | Anderson . | |
| 1,494,454 | 5/1924 | Wanner | 446/66 X |
| 2,059,131 | 10/1936 | McGall | 446/62 |
| 2,711,613 | 6/1955 | Brown | 446/199 |
| 2,812,184 | 11/1957 | McGee . | |
| 3,221,441 | 12/1965 | Shapiro | 446/67 |
| 3,481,069 | 12/1969 | Meyer . | |
| 3,514,108 | 5/1970 | Tepper et al. . | |
| 3,553,884 | 1/1971 | Dunstan . | |
| 3,590,518 | 7/1971 | Lebaron . | |
| 3,606,328 | 9/1971 | Delphia, Jr. . | |
| 3,611,622 | 10/1971 | Lemelson . | |
| 3,923,302 | 12/1975 | Boggild . | |
| 4,064,647 | 12/1977 | Lemelson | 446/65 |
| 4,199,142 | 4/1980 | Reick . | |
| 4,209,937 | 7/1980 | Witte | 446/63 |
| 4,235,040 | 11/1980 | Trowbridge . | |
| 4,249,334 | 2/1981 | Goldfarb et al. . | |
| 4,438,587 | 3/1984 | Marino | 446/202 |
| 4,507,096 | 3/1985 | Greenfield, Jr. . | |
| 4,605,229 | 8/1985 | McKay . | |
| 4,925,188 | 5/1990 | McKay et al. . | |
| 5,057,050 | 10/1991 | Hill . | |

FOREIGN PATENT DOCUMENTS 2511990 9/1976 Fed. Rep. of Germany .

*Primary Examiner*—Danton D. DeMille
*Attorney, Agent, or Firm*—Wood, Herron & Evans

[57] ABSTRACT

A toy dragster includes a body supported at its front end by a pointed skate and at its rearward end by a curved acetate bouncer. A wingplate extends downwardly from the rearward end of the body, and the bottom of the wingplate supports the back end of the curved bouncer. Together, the bouncer and the skate support the dragster above a smooth racing surface. A blast of air directed at the wingplate propels the dragster along a smooth surface at a high rate of speed.

9 Claims, 4 Drawing Sheets

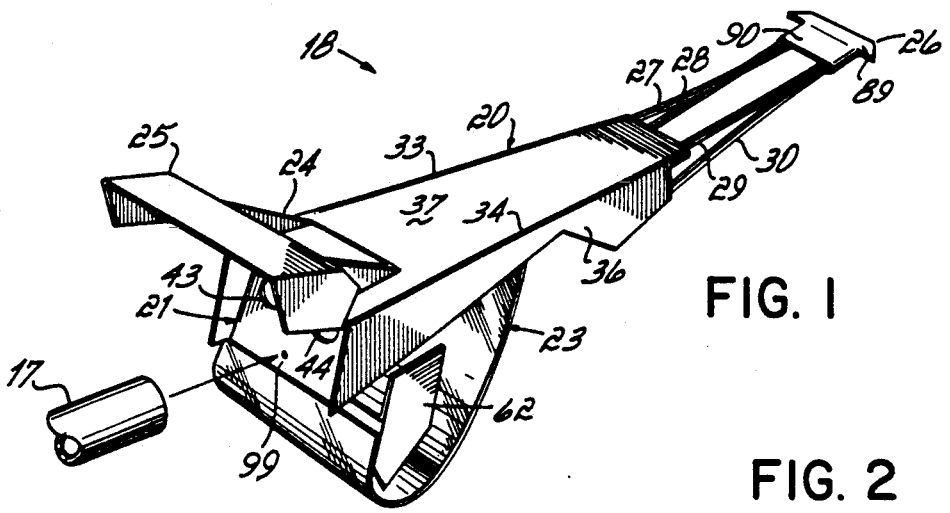
FIG. 1
FIG. 2
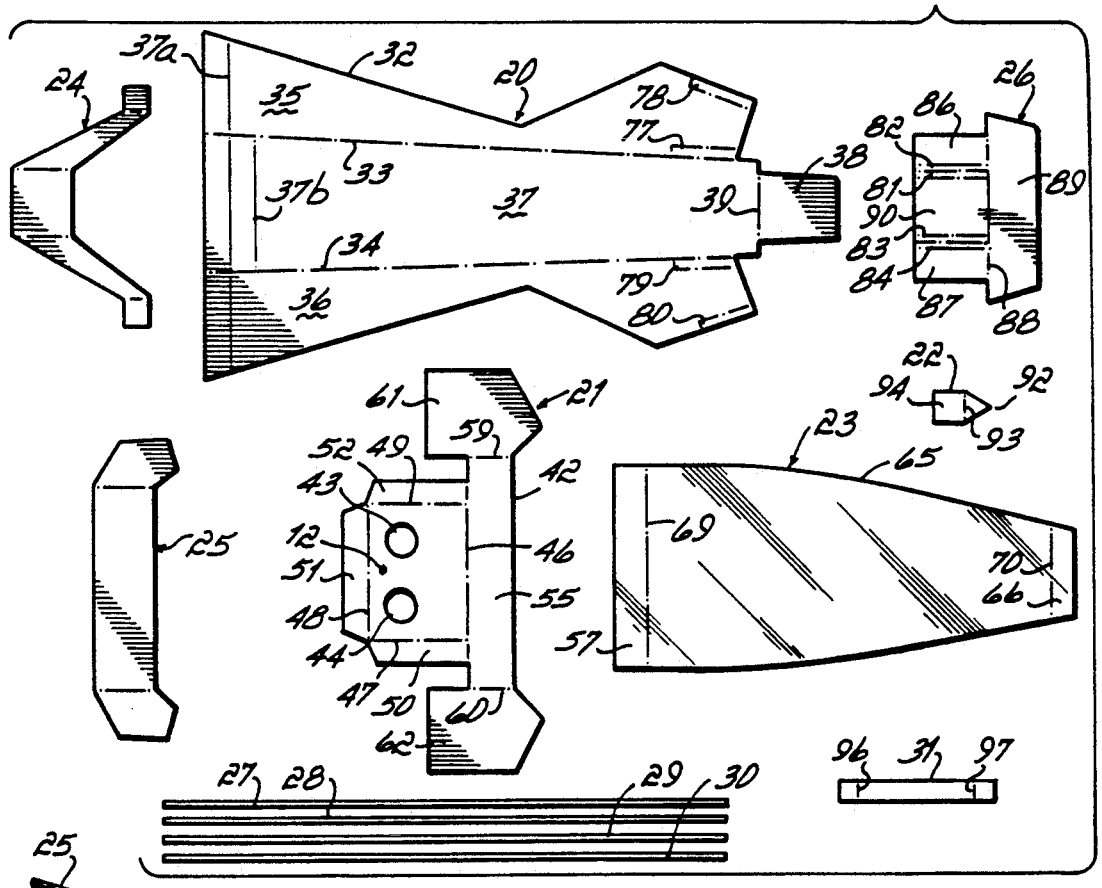
FIG. 3

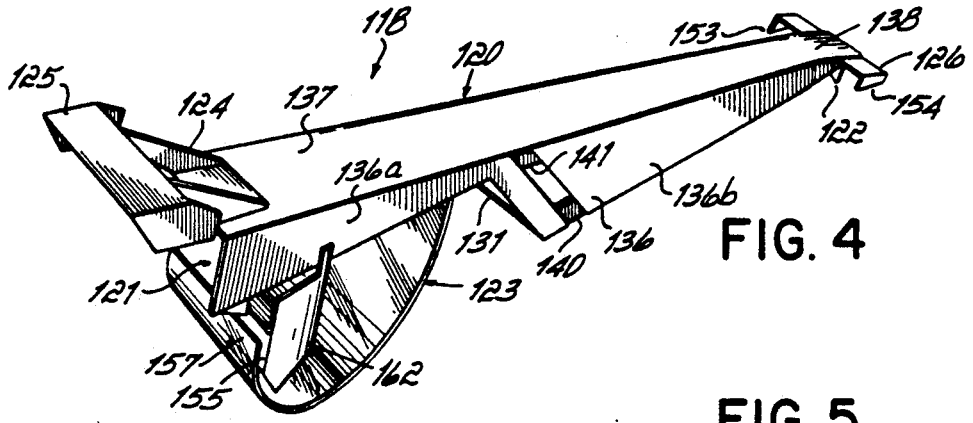
FIG. 4
FIG. 5
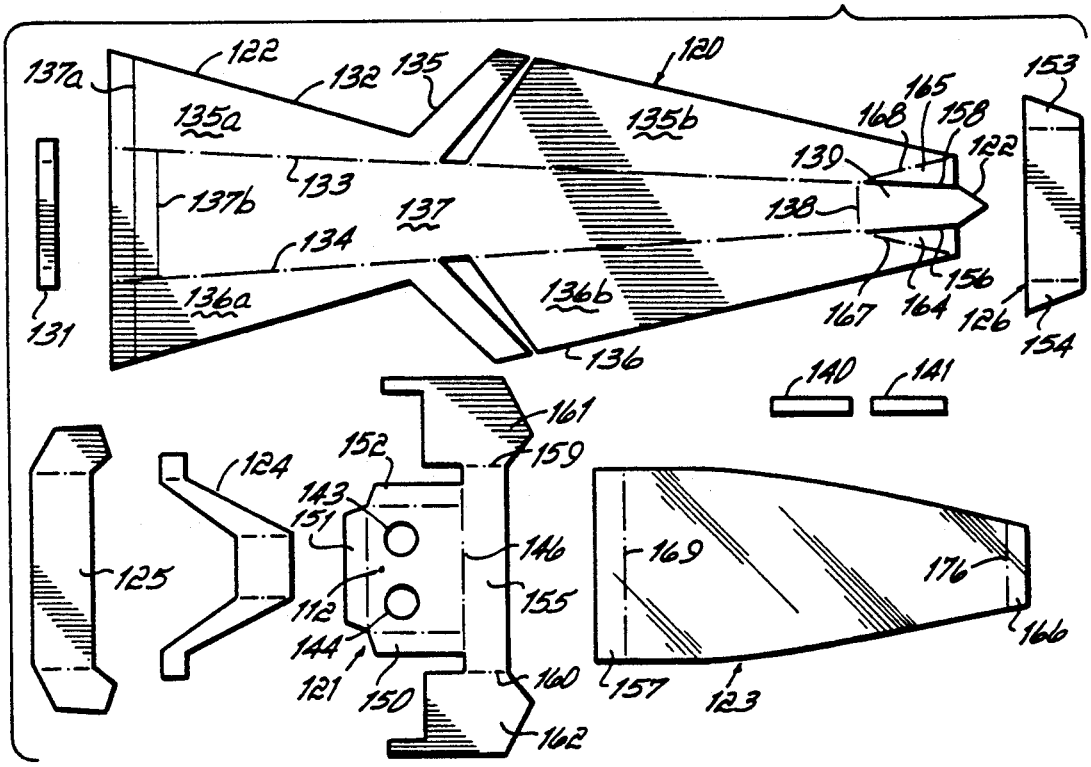
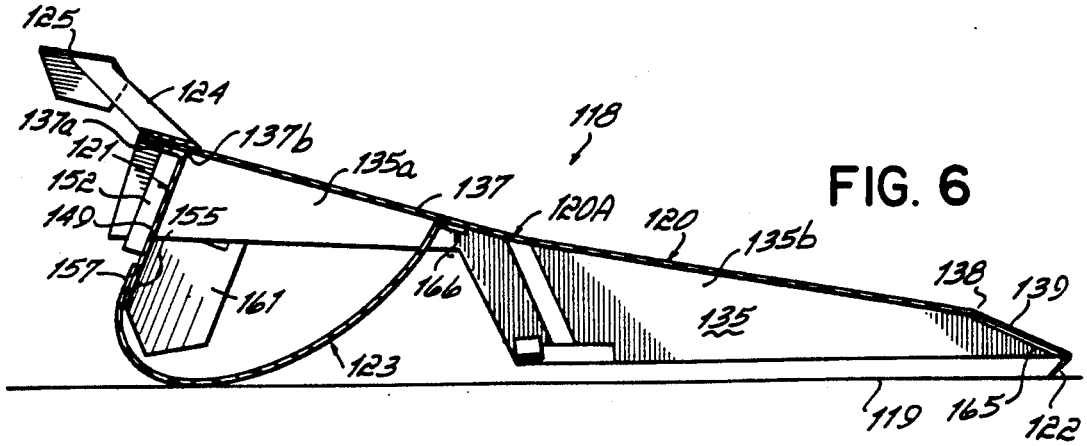
FIG. 6

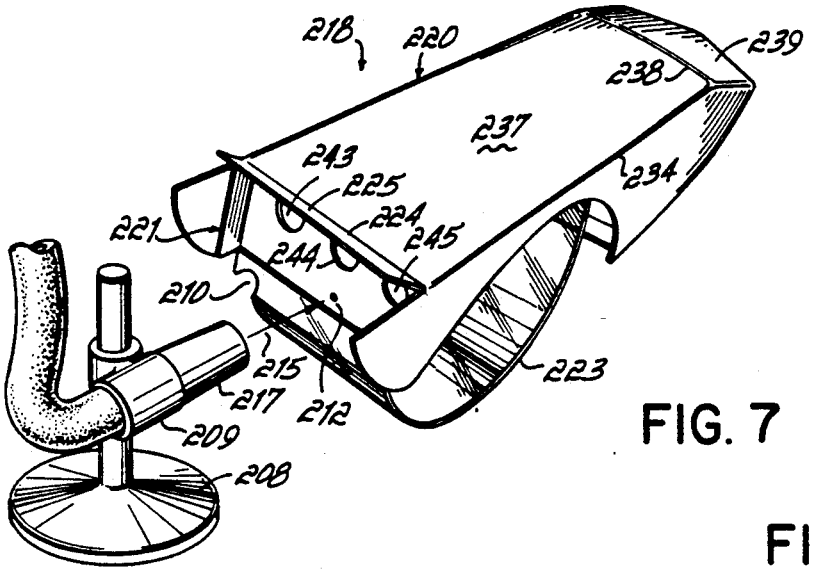
FIG. 7
FIG. 8
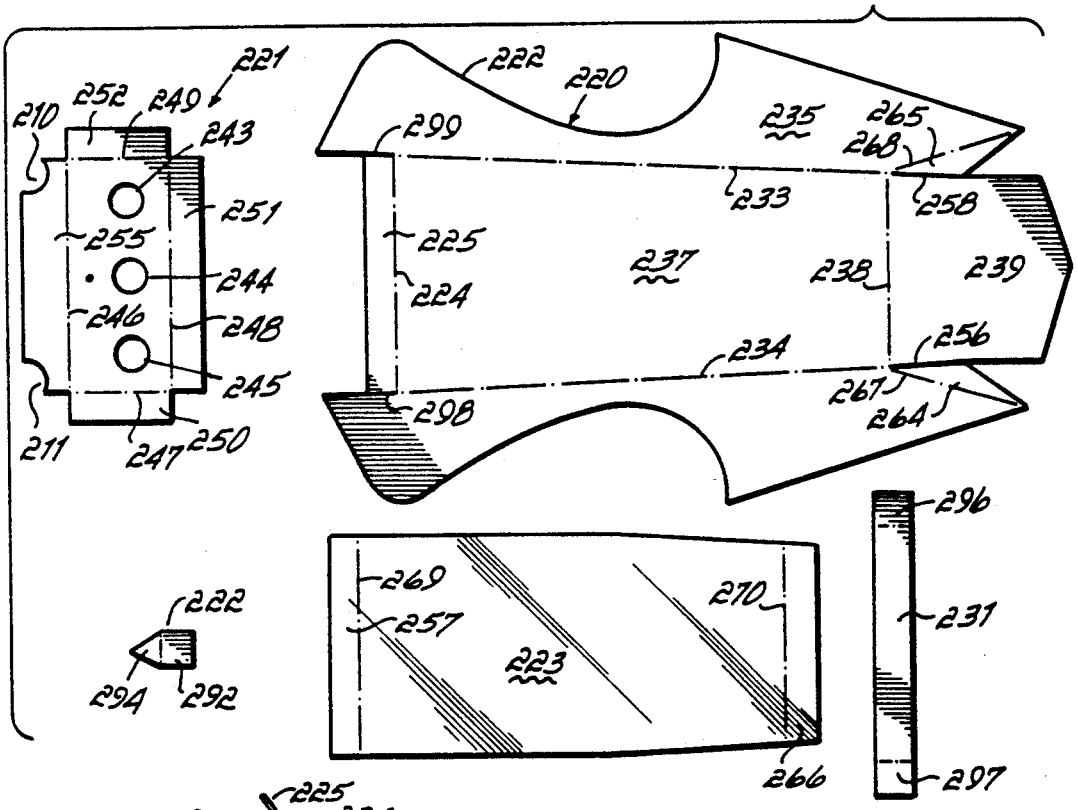
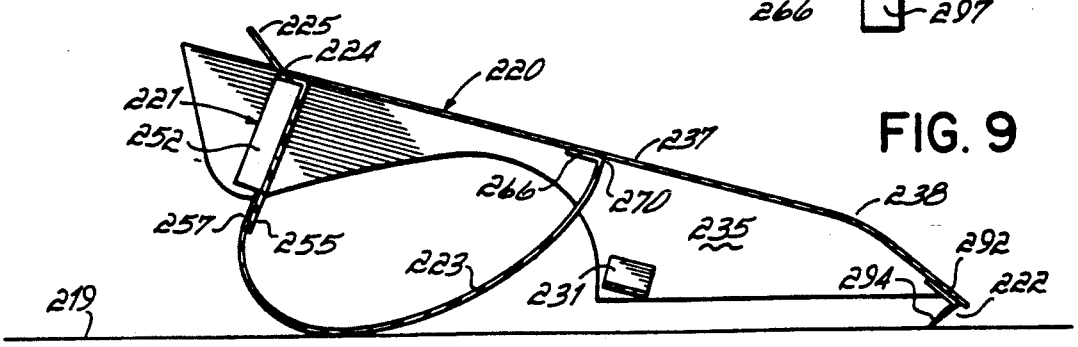
FIG. 9

AIR PROPELLED TOY DRAGSTER CAR

FIELD OF THE INVENTION

This invention relates to a miniature toy dragster which may be propelled along a smooth surface by a blast of air, as by a blow gun.

BACKGROUND OF THE INVENTION

Due to the popularity of dragracing among young and old alike, a number of dragster toys have been available in the past. While some of these toys have been more commercially successful than the others, all of them simulate one or more of the features of the sport of dragracing. This invention represents an improvement over prior toy dragsters, due to its lightweight, low cost, simplicity in design, sturdiness, stability in performance, and perhaps most importantly, its ability to achieve high speeds.

The invention contemplates a toy dragster which includes, as its basic components, a body, a skate, a bouncer and a wingplate. The skate and the bouncer support the forward and the rearward ends of the body, respectively, while the wingplate is located adjacent to the rearward end of the body and is adapted to be acted upon by a jet blast of air, as by a blow gun, to propel the car along a smooth surface. Due to the streamlined design of these components, along with several additional components which provide stability in performance, and which will be described later, this lightweight toy dragster is able to achieve extremely high rates of speed over a smooth surface. Some of these dragsters built according to the teachings of this invention have covered a 96 inch straight flat course in less than 0.020 seconds.

While the invention contemplates a number of embodiments, each of the embodiments incorporates the basic components described above. The body is basically an aerodynamically shaped rectangular box The skate attaches to the front end of the body and extends downwardly. The bottom of the skate comes to a point so that, at its forward end, the dragster has very little physical contact with the racing surface. The skate maintains the forward direction of the dragster.

The bouncer is connected to the body such that it provides a curved surface for supporting the rearward end of the dragster above the-smooth surface. The bouncer has a forward section which attaches to the bottom surface of the body, between the forward and rearward ends, and a rearward section which attaches to the wingplate. The bouncer serves as a motion amplifier to enhance propulsion of the dragster.

The wingplate mounts to the rearward end of the body, in substantially vertical orientation, but tilted somewhat forwardly. The wingplate serves as a striking surface for a jet blast of air which propels the dragster along the smooth surface. The size and shape of the wingplate plays an important role in determining the speed capability of the dragster.

This toy dragster may be propelled by a blast of air blown through a hollow tube aimed at the wingplate. This manner of propelling the dragster is suitable when the racing surface is a table and the operator can kneel behind the dragster at a desired vertical level. However, if the dragster is to be propelled along the floor, it may be inconvenient to orient the tube at the optimum angle and then blow air through, particularly if the individual elderly or has difficulty crouching over.

This invention also contemplates the use of a blow gun assembly which includes a support for holding a rigid forward tube of a blow gun at a preferred angle with respect to the wingplate of the dragster and a flexible tube which connects to a rearward end of the rigid tube. The connection of a flexible-tube to the already mounted rigid tube enables an individual to stand or sit in a comfortable position while blowing into the flexible tube to deliver a blast of air to a preferred strike point of the wingplate.

These and other features of the invention will be more readily understood in view of the following detailed description and the drawings.

BRIEF DESCRIPTION OF THE DRAWINGS

FIG. 1 is a perspective view showing a toy dragster in accordance with a first preferred embodiment of the invention, with the end of a tubular blow gun directed at the rear of the dragster.

FIG. 2 depicts the components of the dragster shown in FIG. 1, but prior to assembly.

FIG. 3 is a longitudinal cross-sectional view of the toy dragster shown in FIG. 1.

FIG. 4 is a perspective view of a toy dragster in accordance with a second preferred embodiment of the invention.

FIG. 5 depicts the component parts of the toy dragster shown in FIG. 4, but prior to assembly.

FIG. 6 is a longitudinal cross-sectional view of the toy dragster shown in FIG. 4.

FIG. 7 is a perspective view of a toy dragster in accordance with a third embodiment of the invention, along with a blow gun support assembly used to propel the toy dragster in accordance with an alternative mode of operation.

FIG. 8 depicts the component parts of the toy dragster shown in FIG. 7, but prior to assembly.

FIG. 9 is a longitudinal cross-sectional view of the toy dragster shown in FIG. 7.

DETAILED DESCRIPTION OF THE DRAWINGS

Figure 10:
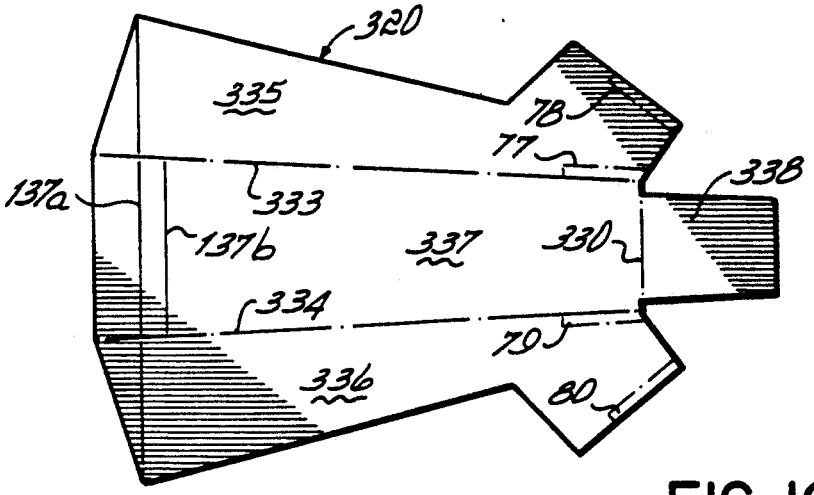
FIG. 10 depicts the body of a toy dragster in accordance with a fourth preferred embodiment of the invention.

FIG. 1 shows a toy dragster 18 constructed according to a first embodiment of the invention. The dragster 18 includes a body 20, a wingplate 21, a skate 22 (best seen in FIG. 2 and 3), and a bouncer 23. The skate 22 and the bouncer 23 support the forward and rearward ends, respectively, of the body 20 above a smooth racing surface 19 (shown in FIG. 3). Wingplate 21 is also located adjacent the rearward end of the body 20. The dragster 18 further includes a strut wing connecter 24 which supports a strut wing 25 above and behind the rearward end of the body 20. A front wing 26 is located at the forward end of the dragster 18. The front wing 26 connects to the body 20 via four I-beams 27, 28, 29, and 30, which are preferably 1/16" plastic beams sold by Plastruct.

Applicant refers to this embodiment of this invention as the "rear engine rail". This particular embodiment has proven in time trials to be one of the fastest of all of the designs.

FIG. 2 shows the components of the dragster 18 prior to assembly. The first step in forming the dragster 18 involves construction of the body 20. Preferably, the body 20 is formed from a sheet of 8 inch by 10 inch cibachrome photographic paper (triacetate body material). cibachrome provides sturdy, lightweight structural support for the dragracer 18. A pattern or outline 32 is cut from a sheet of cibachrome, as shown in FIG. 2. To form the body 20, pattern 32 of cibachrome is folded along side fold lines 33 and 34 to form sides 35 and 36, respectively. A front 38 of the body is formed by folding along a front fold line 39.

The body 20 includes a wingplate line 37*a* and a rake line 37*b*. The wingplate line 37*a* is preferably ½" or ⅛" from the edge, and the rake line 37*b* is preferably ⅛" from the wingplate line 37*a*. A higher rake, i.e. greater distance between rake line 37*b* and wingplate line 37*a* results in more elongation of the bouncer 23. In applicant's view, this elongation tunes the dragster 18 to an optimum performance frequency.

Wingplate 21 is also preferably cut from a piece of cibachrome according to the pattern 42 shown in FIG. 2. The pattern 42 includes the actual wingplate 21, portholes 43 and 44 in the wingplate 21 which, in use, relieve dammed up air to allow easier air flow and better high speed handling. The wingplate 21 is defined by four fold lines 46, 47, 48, and 49. Fold lines 47, 48, and 49 define tabs 50, 51, and 52 respectively. Tabs 50, 51, and 52 are folded at 90 degree angles with respect to the wingplate 21, and they are secured with super glue to side flap 36, mid-portion 37 and side flat 35, respectively, of the body 20. The rearward edge of tab 51 is aligned with wingplate line 37*a*, and the forward edge of tab 57 is aligned with rake line 37*b*. As mentioned previously, with this construction, the rake of the wingplate 21 depends upon the locations of the wingplate line 37*a* and rake line 38*a*.

Adjacent to fold line 46, wingplate pattern 42 includes a tab 55 to which a rearward section 57 of the bouncer 23 is attached. The tab 55 also has fold lines 59 and 60 which define side canards 61 and 62, respectively. The canards 61 and 62 fold forwardly along the body 20. Preferably, the canards 61 and 62 are parallel with the longitudinal dimension of the dragster 18, i.e. perpendicular to the wingplate 21.

The bouncer 23 is preferably made of acetate and cut to a pattern 65 shown in FIG. 2. The pattern 65 is about one and half inches wide at its widest point, and about three inches long. The rear section 57 is about 1 ½" by ¼", while a front section 66 is about ¾" by 3/16". The rear section 57 and the front section 66 are defined by fold lines 69 and 70, respectively. When attached to the body 20, the front section 66 should be about two inches from the rear section 57. When the bouncer 23 is properly attached to the body 20, a transverse portion 73 of the bouncer 23 will rest flat on the surface 19 to support the dragster 18 (FIG. 3). The bouncer 23 extends transversely to the longitudinal axis of the body 20, thereby supporting and balancing the rearward end of the body 20 transverse to the longitudinal axis thereof.

The I-beams 27, 28, 29, and 30 are glued to the body 20 along surfaces 77, 78, 79, and 80, respectively. Preferably, about ¾" of the 4" length of each I-beam is connected to the body 20. The forward ends of the I-beams 27, 28, 29, and 30 are glued to the front end 26 at locations 81, 82, 83, and 84, respectively. Thus, the forward ends of the lower connected I-beams 28 and 30 are located outside of the forward ends of the higher connected I-beams 27 and 29. Flaps 86 and 87 of the front wing 26 fold around the adhered forward end of I-beams 27, 28, 29, and 30. Preferably, front wing 26 has a fold line 88 which distinguishes between the forward section 89 and the rearward section 90. During construction, it may be advantageous to use masking tape around the I-beams for temporary support.

It is possible for the skate 22 to fold downwardly from the first section 89 of the front wing 26, so as to be integral therewith. It is also possible for the skate 22 to be made as a separate piece and adhered to the bottom of the forward section 89 of front wing 26, as shown in FIG. 2. Preferably, skate 22 includes a pointed section 92 and a tab 94 separated by a fold line 93. The pointed section 92 includes a tip which contacts surface 19 to support the forward end of the dragster 18 (See FIG. 3).

A wingtree 31 includes folded tabs 96 and 97 which are adhered to sides 35 and 36 at the rearward ends of the I-beams 27, 28, 29, and 30. The wingtree 31 may be oriented as shown in FIG. 3, or with the tabs 96 and 97 oriented parallel with the ground 19.

The speed of the dragster 18 will depend on the angle and location of the blow gun 17 with respect to the wingplate 21. It is desirable to locate an indicator dot 12 on the wingplate 21 to show a desired strike point for the jet of air which will propel the dragster 18 along the surface 19. Only a trial and error process will enable the user to determine the optimum position and angle of the blow gun 17 with respect to the wingplate 21 to produce the highest speed along a straight line. Ideally, the gun 17 should be pointed upwardly toward the wingplate 21.

FIG. 4, 5, and 6 are similar to FIG. 1, 2, and 3, respectively, but these figures show a second embodiment of the invention which applicant refers to as the "top fuel dragster". Most of the components of the second embodiment are similar or identical to corresponding components for the first embodiment. The components of the dragster 118 shown in FIG. 4, 5, and 6 are indicated by reference numerals which are identical to the corresponding components of dragster 18, but include an additional numerical to designate these components as the 100 series.

As with dragster 18, dragster 118 is formed from cibachrome, with the bouncer 123 formed from acetate. The parts are held together by super glue according to a preferred structural orientation.

Again, a pattern 132 for the body 120 is cut from a sheet of cibachrome. Sides 135 and 136 are formed by folding the pattern 132 along fold lines 133 and 134 respectively. Sides 135 and 136 include rearward portions 135*a* and 136*a*, respectively, along with forward portions 135*b* and 136*b*, respectively. On each side of the dragracer 118, the side portions 135*a* and 135*b* (or 136*a* or 136*b*) are interconnected by a connector 140 (or 141). The wingplate line 137*a* and the rake line 137*b* are identical to the same components shown in FIG. 2 for the first embodiment. Additionally, dragster 118 differs from dragster 18 in the shape of the canards 161 and 162. If desired, the skate 122 may be formed intergrally from the front end of the body 120.

The skate 122 actually extends from the forward end of the front flap 139, which is formed by folding along 138. Cuts are formed in the pattern 132 along the heavy lines designated by numerals 156 and 158. The side flaps 136*b* and 135*b* are then folded along fold lines 167 and 168, respectively. Angular portions 164 and 165, which are defined by fold lines 167 and 168, respectively, are then extended under and secured to-the bottom of front flap 139 in overlapping relationship.

For dragster 18 and dragster 118, the top of the body 20 (or 120) has a transition, or inflection point, 20*a* (or 120*a*) about midway between the skate 22 (122) and the bouncer 23 (123) to provide rake for the body 20 (220). This body rake helps minimize the weight carried by the skate 22 (122).

FIG. 7, 8, and 9 show a third embodiment of the invention, which the inventor refers to as the "funny car". Perhaps the simplest of all of the designs, the funny car dragster 218 incorporates all of the same basic components as the other designs. With respect to FIG. 7, 8, and 9, reference numerals of components which are identical or similar to those of the other embodiments are identical but have an additional numeral and are in the 200 series.

The body 220 is formed from a pattern 232 cut from a sheet of cibachrome, and the body 220 includes a center section 237 bordered by fold lines 224, 233, 234 and 238. Fold line 224, along with cuts 289 and 299 define a rear wing flap 225. Fold lines 233 and 234 define sides 235 and 236, respectively. Front fold 238 defines front flap 239. The sides of front flap 239 are defined by cuts 256 and 258. After these cuts 256 and 258 have been made, flaps 264 and 265, which are defined by fold lines 267 and 268, respectively, are extended under and adhered to the bottom of front flap 239, and the sides 235 and 236 are folded along folds 233 and 23.4, respectively.

Another structural difference between the dragster 218 and the other embodiments relates to the wingplate 221. Wingplate 221 includes three port holes as indicated by numerals 243, 244 and 245. This is due to the greater width of the wingplate for this particular dragster 218. Additionally, the bottom flap 255 of the wingplate 221 has two semicircular cut out regions defined by arches 210 and 211.

FIG. 10 shows a cut out for the body 320 of a dragster 318 constructed in accordance with a fourth preferred embodiment of the invention. The fourth embodiment 318 is very similar to the first embodiment 18, with the same components and construction but with a slightly different shape for the body 320. In time trials of the invention, the first and second embodiment produce consistently first times. This fourth embodiment 318 has produced one of the fastest times to date.

For the four embodiments shown, FIGS. 2, 5, 8 and 10 are scaled down from actual size by a ratio of 0.75 to 1.

FIG. 7 also shows a rigid blow gun end piece 217 vertically adjustably connected to a stand 208 via a clamp 209. The stand 208, the clamp 209, and the end piece 217 may be oriented so as to direct a blast of air at the optimum strike point 212 on the wingplate 221, as shown by directional arrow 215. A flexible tube 216 is insertable into the back end of the tube 217. This construction enables an individual to blow into the hose 216 to direct a blast of air out of the tube 217 at the preferred strike point 212, without having to lie down on the floor or kneel next to a table, depending upon whether the dragster 18, 118, 218 or 318 is raced upon a smooth surface provided by a floor or a table. Other variations of this assembly would also be possible.

When using the tube 17 to supply the blast of air to propel the dragster 18, applicant has learned that preferable sizes are 5 and ⅝ inches to 6 and ½ inch in length, with a diameter of about 0.580" at the mouth piece and a diameter of 0.350 of an inch at the muzzle end, i.e. the end which is placed near the wingplate 21, 121, or 221. While a short gun is generally faster, a longer gun enables the user to achieve better control of the direction of the applied air, and hence the direction of the dragster 18. This could be important if the dragster is run on a track which is supported on a table or a floor and the user must keep the gun a specified distance from the end of the track in which the dragster 18 is resting.

Applicant developed the blow gun with the theory that increasing the diameter of the bouncer 23 and improving the aerodynamics of the dragster 18 would eliminate or reduce the weight at the front end. While the dragster toys constructed in accordance with this invention generally weigh in the range of 3 to 8 grams, the weight supported by the skate 22 is extremely low relative to the weight supported by the bouncer 23. In effect, the weight support ratio of the bouncer 23 to the skate 22, along with the aerodynamic construction of the body 20, and the cibachrome composition of the body 20, enable these dragsters 18 to achieve extremely high speeds.

Applicant has learned that a preferable angle of the blow gun 17 with respect to wingplate 21 is approximately 30 degrees upward from horizontal. By trial and error, user will learn how to operate the blow gun so as to simulate a dragracing "burnout", which is typically performed before a run. Additionally, a user will also be able to make the dragster 18 do a "wheelie".

For actual running of the dragster 18, the blow gun 17 must be held that such the muzzle end is higher than the mouthpiece. Generally, for the funny car 218, a faster run will be achieved with the blow gun 17 aimed lower at the wingplate 21. However, if aimed too low, the dragster 218 will roll off the surface 19 and head skyward. For the dragster 18, 118 and 318, which have a wedge-type wingplate, the aim point may be higher. However, if the aim point is too high, the dragster will not be sufficiently powered or will run out of control. If the dragster veers to the left, the aim point on the wingplate should be moved to the left. Similarly, if the dragster goes to the right, the aim point should be moved to the right.

Basically, the actual performance of the dragster 18, 118, 218 or 318 will depend upon a number of factors which may be varied to suit the owner, including the rake of the body, the size of the wingplate, the number of holes in the wingplate, the rake of the wingplate, etc. Other critical factors include the racing surface and the type of blowgun. Finally, actual performance has a significant human factor, i.e., the skill of the user operating the blow gun 17. To achieve optimum results, these skills will need to be developed by trial and error over a period of time.

The invention in its broader aspects is therefore not limited to the specific details, representative apparatus and method, and illustrative examples shown and described. Accordingly, departures may be made from such details without departing from the spirit or scope of applicants' general inventive concept.

I claim:

1. A toy dragster suitable for propulsion along a smooth surface comprising:

a body having forward and rearward end aligned along a longitudinal axis;

a skate extending downwardly from the forward end of the body, the skate including a tip for contacting the smooth surface and supporting the forward end of the body above the smooth surface along the longitudinal axis;

a bouncer connected to the body between the forward and rearward ends, the bouner supporting and balancing the rearward end of the body transverse to the longitudinal axis, the bouncer being curved and having front and rear sections, wherein the front section connects to the body between the forward and rearward ends and the rear section of the bouncer connects to the wingplate; and a wingplate oriented substantially perpendicular to the longitudinal axis and adapted to be acted upon by a blast of air to propel the dragster along the smooth surface.

2. The toy dragster of claim 1 wherein the wingplate has at least porthole.

3. The toy dragster of claim 1 wherein the wingplate is rectangular and includes at least two arcuately cut-out regions.

4. In combination, the invention comprising:

a body having forward and rearward ends;

a skate extending downwardly from the forward end of the body, the skate including a bottom tip for supporting the forward end of the body above a smooth surface;

a wingplate extending downwardly from the rearward end of the body;

a bouncer having forward and rearward sections, the rearward section connected to a bottom of the wingplate and the forward section connected to the body between the forward and the rearward ends, thereby forming a curved support member for supporting the rearward end of the dragster; and means for directing a blast of air through a tube toward the wingplate, thereby to propel the dragster along the smooth surface.

5. The invention of claim 4 wherein said means for directing further comprises:

a stand adapted to rest on a smooth surface;

a rigid tube connected to the stand, the tube having a forward end oriented at a predetermined angle with respect to the smooth surface; and a flexible tube connected to the rearward end of the rigid tube, whereby a blast of air blown into the flexible tube will flow through the flexible and the rigid tubes and exit the rigid tube in the direction of the wingplate at a preferred angle to propel the dragster along the smooth surface.

6. The invention of claim 4 wherein the body, the skate and the wing plate are made of cibachrome.

7. The invention of claim 4 wherein the bouncer is made of acetate.

8. A toy dragster comprising:

a cibachrome body having forward and rearward ends;

a cibachrome skate extending downwardly from the forward end of the body, the skate including a tip for supporting the forward end of the body above a smooth surface;

a cibachrome wingplate extending downwardly from the body adjacent the rearward end thereof; and a bouncer having forward and rearward sections, the rearward section of the bouncer connected to the wingplate and the forward section of the bouncer connected to the body between said forward and rearward ends, the bouncer being curved between its connected first and second sections and adapted to support the rearward end of the body, whereby a blast of air directed at the wingplate propels the dragster along the smooth surface.

9. The toy dragster of claim 8 wherein the total weight of the dragster is between 3–8 grams.

* * * * *